United States Patent [19]

Lyons et al.

[11] Patent Number: 4,811,579

[45] Date of Patent: Mar. 14, 1989

[54] CASH DRAWER RELEASE MECHANISM

[75] Inventors: Dale R. Lyons, Cambridge; Raymond L. Lawter, Millersburg; Don E. Beam, Cambridge, all of Ohio

[73] Assignee: NCR Corporation, Dayton, Ohio

[21] Appl. No.: 125,853

[22] Filed: Nov. 27, 1987

[51] Int. Cl.[4] ..... E05B 65/4C

[52] U.S. Cl. ..... 70/85; 312/333

[58] Field of Search ..... 70/85, 86, 87, 88, 63; 312/333, 216–222, 107.5; 109/19, 45, 50–52, 58.5, 59 R, 66

[56] References Cited

U.S. PATENT DOCUMENTS

| | | | |
|---|---|---|---|
| 1,000,268 | 8/1911 | Jadronja . | |
| 2,017,669 | 10/1935 | Meilink | 70/50 |
| 2,145,314 | 1/1939 | Murtaugh, Jr. | 70/85 |
| 2,836,353 | 5/1958 | Waechter | 235/22 |
| 3,674,360 | 7/1972 | Ratner | 312/222 |
| 4,246,769 | 1/1981 | McLaughlin | 70/85 |
| 4,268,076 | 5/1981 | Itoi | 70/87 |
| 4,363,229 | 12/1982 | Baitz | 70/279 |
| 4,552,075 | 11/1985 | Glasson | 312/333 |

*Primary Examiner*—Robert L. Wolfe

*Attorney, Agent, or Firm*—Wilbert Hawk, Jr.; Albert L. Sessler, Jr.; Richard W. Lavin

[57] ABSTRACT

A manually operated release mechanism includes a spring actuated latch mechanism for latching a cash drawer within an enclosure upon movement of the cash drawer to a closed position. A rod member rotatably mounted adjacent the latch mechanism extends to a position adjacent the front edge of the enclosure. A drive member located adjacent the front edge of the enclosure has two cam surfaces, one of which is positioned adjacent one end of the rod member. When the cash drawer is in the closed position, a key actuated locking assembly on the cash drawer moves the drive member to an actuated position which engages and rocks the rod member to a position releasing the latching mechanism from engagement with the cash drawer. A depending tab portion of the cash drawer engages and slides the drive member to a home position upon opening of the drawer. The locking member disables the cash drawer from being operated by a solenoid mounted within the enclosure structure when moved to a locking position.

12 Claims, 8 Drawing Sheets

CASH DRAWER RELEASE MECHANISM

BACKGROUND OF THE INVENTION

The present invention is directed to a cash drawer associated with a data terminal device and more particularly to a mechanism for releasing the cash drawer from engagement with the terminal device.

In modern data terminal or electronic cash register devices used in a checkout operation, the opening of the cash drawer prior to the removal of change is automatically controlled by the operation of certain control keys on the keyboard of the terminal device. The operation of these control keys disables the latching mechanism latching the drawer to the terminal device. However, it has been found that there are certain situations such as the occurrence of a power outage or certain supervisory functions which require that the cash drawer be released from engagement with the terminal device without disturbing the control mechanism that controls the disabling of the latching mechanism latching the cash drawer in a closed position.

It is therefore a principal object of this invention to provide a manual release mechanism for a cash drawer associated with a data terminal device.

It is another object of this invention to provide a locking arrangement for a cash drawer which locks the cash drawer in a closed position while preventing the cash drawer latching mechanism from being disabled.

It is a further object of this invention to provide a manual release mechanism for a cash drawer which is simple in construction and therefore low in cost.

SUMMARY OF THE INVENTION

These and other objects of the invention are fulfilled by positioning one end of an elongated actuator member on a base or support member adjacent a latching mechanism which normally latches a cash drawer in a closed position within the support member on which is mounted a data terminal device. The other end of the actuator member is located on the support member adjacent the front edge of the terminal device. A drive member slidably mounted on the support member adjacent the front edge of the terminal device has a cam surface positioned adjacent the other end of the actuator member. A keylock assembly rotatably mounted in the front portion of the cash drawer has a depending arm portion which is aligned with the drive member when the cash drawer is in a closed or latched position. The keylock assembly is adapted to be rotated by the insertion of a key member within the keylock assembly to a first position in which the arm portion is positioned adjacent a cam surface on the drive member locking the drawer in a closed position. The keylock assembly is adapted to be moved to a second position by the insertion of a second key within the keylock assembly which engages and moves the drive member to a position in which the cam surface on the drive member rotates the actuator member to a position disabling the latching mechanism from engaging the cash drawer. Upon the disabling of the latching mechanism, a spring mounted on the support member and engaging the rear edge of the cash drawer moves the cash drawer to an open position. A depending tab member mounted on the underside surface of the cash drawer engages and cams the drive member to its home position during the movement of the cash drawer to an open position.

BRIEF DESCRIPTION OF THE DRAWINGS

Additional advantages and features of the present invention will become apparent and fully understood from a reading of the following description, taken in conjunction with the annexed drawings in which.

DESCRIPTION OF THE PREFERRED EMBODIMENT

Figure 1:
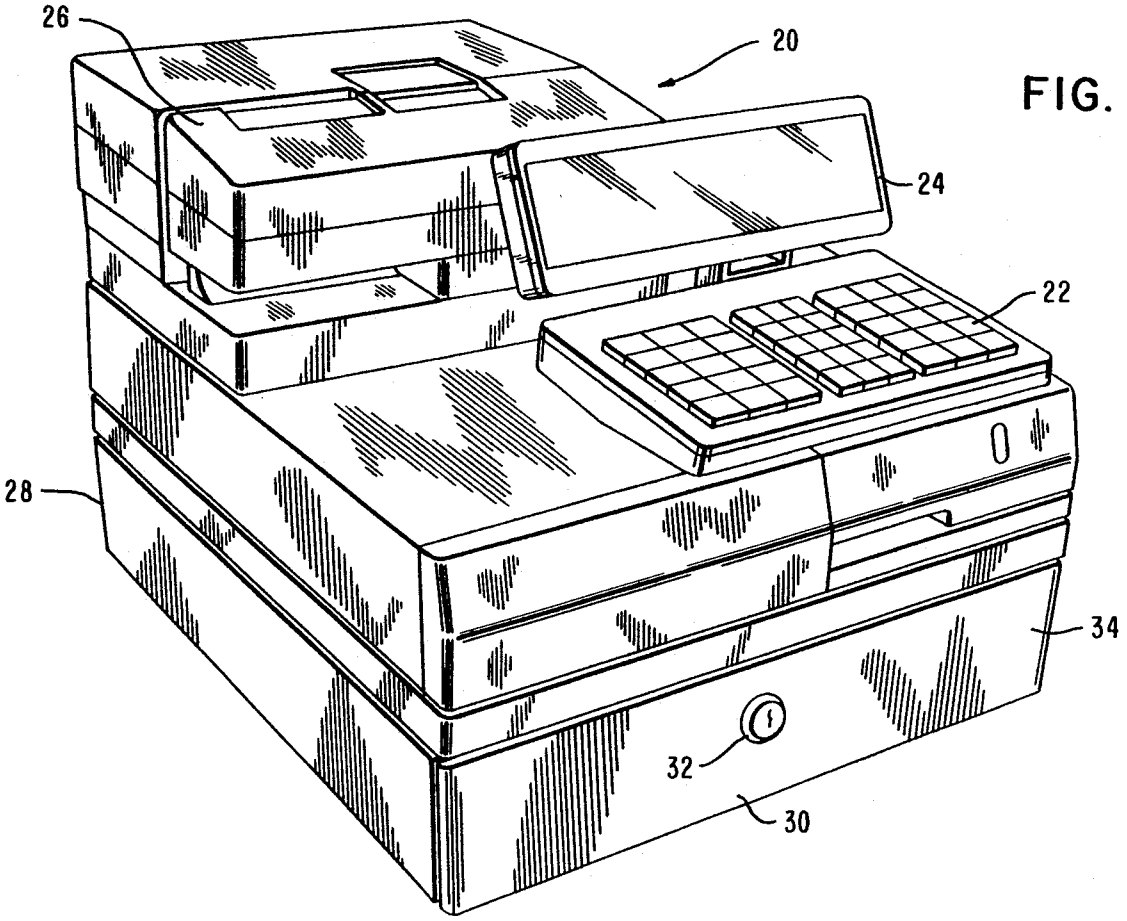
FIG. 1 is a perspective view of a data terminal device showing the base member and the cash drawer on which the terminal device is mounted.

Referring now to FIG. 1, there is shown a perspective view of a typical data terminal device generally indicated by numeral 20 which includes a keyboard 22, a display 24, a printer 26 and a base member 28 in which is slidably mounted a cash drawer 30 used in sales transactions involving the handling of money, particularly checks, bills and coins of different denominations. A keylock assembly 32 mounted in the front wall portion 34 of the cash drawer 30 enables the cash drawer to be locked within the base member 28. As is well known in the art, operation of a control key on the keyboard 22 at the conclusion of the processing of a sales transaction will result in the automatic opening of the cash drawer 30.

Figure 2:
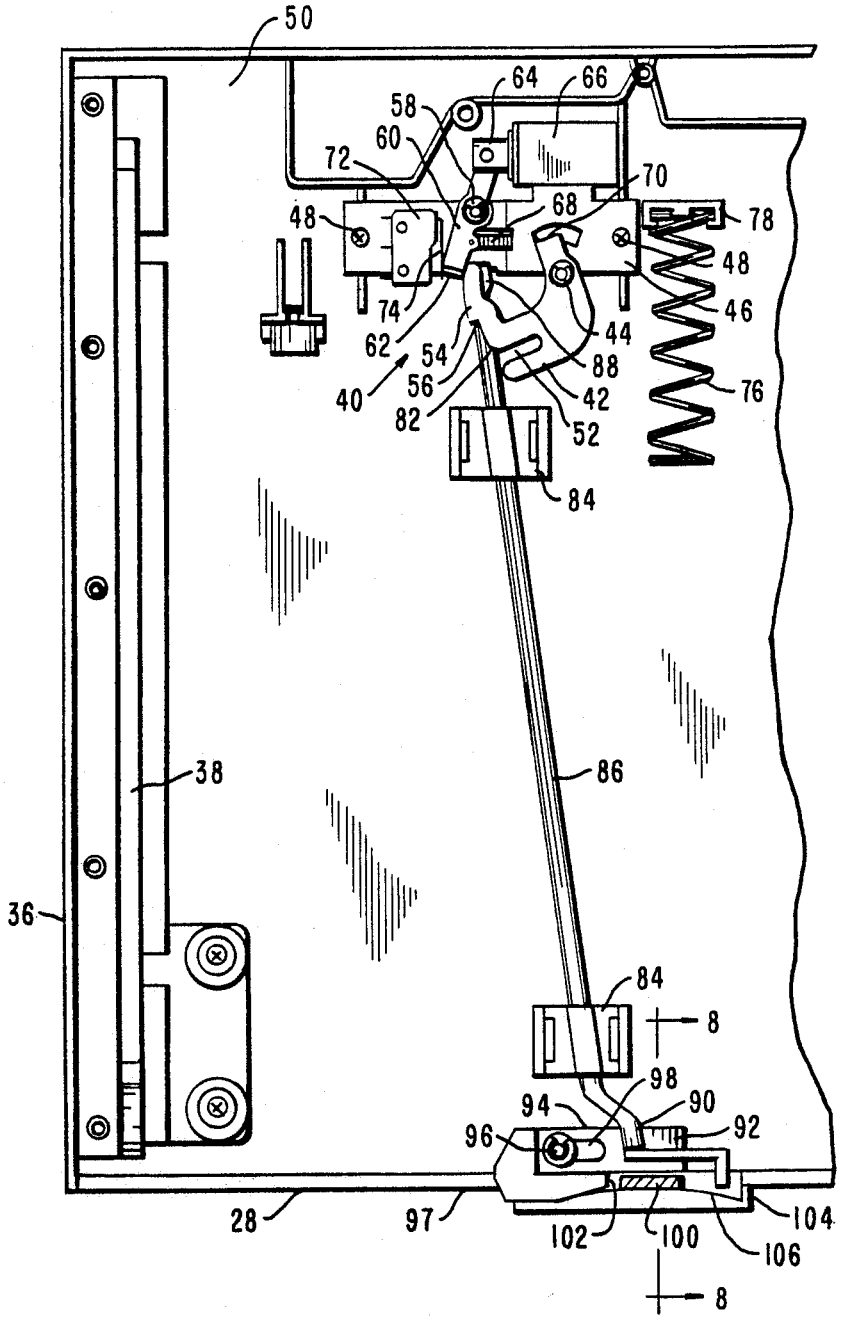
FIG. 2 is a top view of the base member with the cash drawer removed showing the latching mechanism in an unlatched position and the release mechanism in its home position.

Referring now to FIG. 2, there is shown a top view of a portion of the base member 28 (FIG. 1). The base member includes a sidewall portion 36 to which is mounted a track member 38 within which rollers (not shown) mounted on the side of the cash drawer are positioned allowing the cash drawer to slide between a closed and open position within the base member 28. Located at the rear of the base member is a latching mechanism generally indicated by the numeral 40 which latches the drawer in a closed position upon movement of the cash drawer to the closed position. Included in the latching mechanism is a latching member 42 rotatably mounted on a stud 44 (FIG. 5) secured to a support member 46 which in turn is mounted on a supporting structure 49 by means of studs 48 secured to the floor portion 50 of the base member 28. The latching member 42 includes an elongated recessed portion 52 and an arm portion 54 having a notched blocking surface 56 located thereon.

Figure 4:
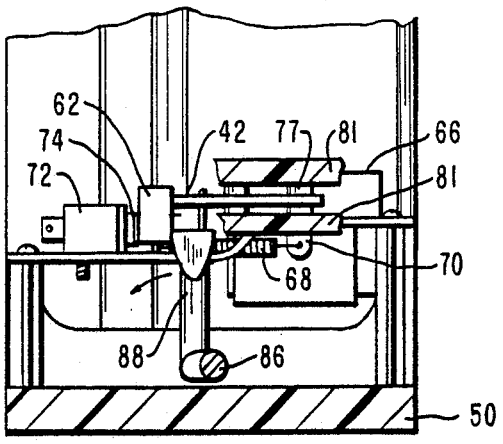
FIG. 4 is an enlarged sectional view of the latching mechanism taken on line 4—4 of FIG. 3.

Rotatably mounted on a stud 58 (FIGS. 2 and 5) secured to the support member 46 is a blocking lever member 60 having a hooked end portion 62 (FIG. 4)

extending in a downward direction. The other end of the blocking member 60 is rotatably secured to the armature member 64 of a solenoid 66 mounted to the support member 46. A spring member 68 mounted between the blocking member 60 and a depending end portion 70 (FIG. 4) of the latch member 42 normally urges the blocking member 60 counterclockwise into engagement with the arm portion 54 of the latch member 42.

Figure 3:
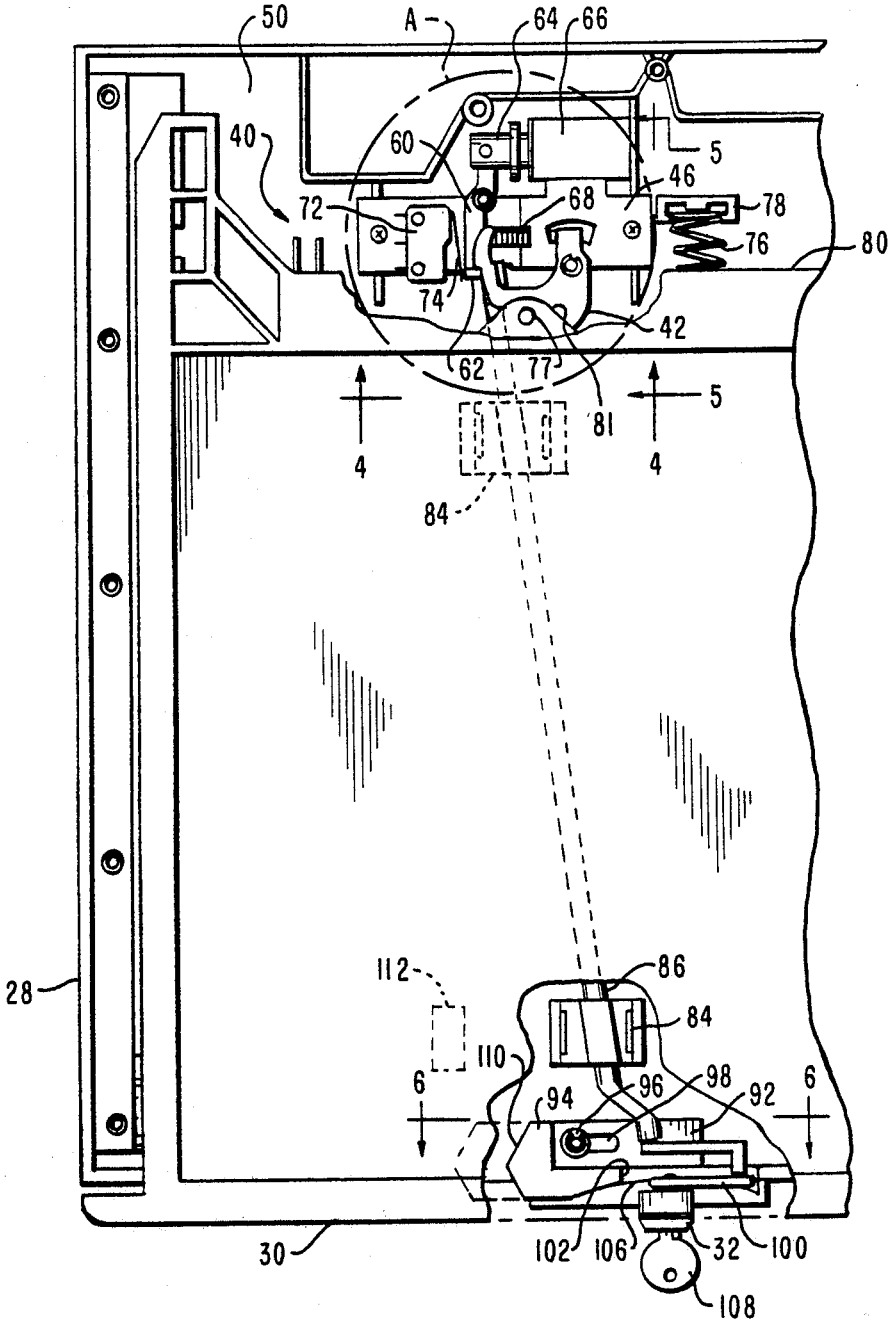
FIG. 3 is a top view of the cash drawer positioned on the base member in a latched or closed position showing the location of the keylock assembly with respect to the actuator member.

As seen in FIGS. 2 and 3, mounted on the support member 46 is a switch member 72 having a switch arm 74 normally biased into engagement with the blocking member 60. A spring member 76 mounted in a support member 78 secured to the floor portion 50 of the base member 28 normally engages the rear edge 80 (FIG. 3) of the cash drawer 30. As will be described more fully hereinafter, disabling of the latch member 42 by operation of the solenoid 66 enables the spring member 76 to move the cash drawer 30 to an open position.

Figure 5:
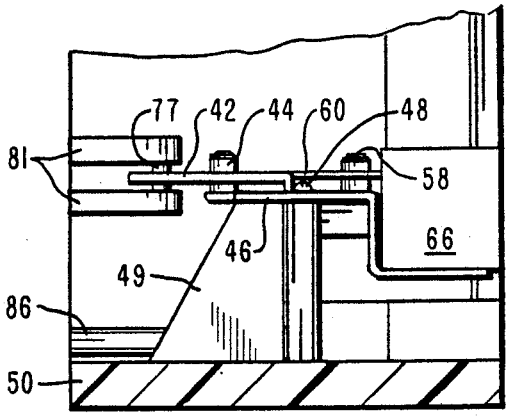
FIG. 5 is an enlarged sectional view of the latching mechanism taken on line 5—5 of FIG. 3.

Referring now to FIG. 3, there is shown a top view of the cash drawer 30 located in a closed position within the base member 28. As best seen in FIG. 5, the rear edge 80 of the cash drawer includes a pair of spaced apart parallel projections 81 in which is mounted a pin 77. Upon movement of the cash drawer towards the rear of the base member 28, the pin 77 will engage an edge portion 82 (FIG. 2) of the latch member 42 rotating the latch member in a clockwise direction enabling the recessed portion 52 of the latch member to capture the pin 77. The clockwise rotation of the latch member 42 moves the blocking surface 56 of the latch member to a position behind the hooked end portion 62 of the blocking member 60 resulting in the end portion 62 dropping behind and engaging the blocking surface 56 of the latch member 42 under the action of the spring member 68 thereby blocking the latch member from further movement resulting in the latching of the cash drawer in a closed position. This movement of the cash drawer to a closed position compresses the spring member 76.

Under normal operation, the solenoid 66 will be energized at the conclusion of a sales transaction by the operation of an appropriate control key on the keyboard 22 (FIG. 1) of the terminal device 20 in a manner that is well known in the art. Operation of the solenoid 66 results in the inward movement of the armature 64 resulting in the clockwise movement of the blocking member 60 thereby releasing the latch member 42 for a counterclockwise movement under the action of the spring 68. This counterclockwise movement of the latch member 42 releases the pin 77 from engagement with the latch member allowing the spring member 76 to move the cash drawer to an open position. The clockwise movement of the blocking member 60 also results in the actuation of the switch member 72 which transmits a signal to the terminal device indicating that the cash drawer has been released for movement to an open position.

It has been found that there exist certain situations where the cash drawer is required to be released without actuating the solenoid 66. These situations include the occurrence of a power outage or when the supervisor is required to open the cash drawer without operating the terminal device. As shown in FIGS. 2 and 3, there is mounted to the floor portion 50 of the base member 28 a pair of holder members 84 within which is rotatably mounted an elongated actuator rod member 86 having an upturned end portion 88 (FIG. 4) positioned adjacent the end portion 62 of the blocking member 60. The other end 90 of the actuator rod member 86 is positioned adjacent a cam surface 92 of a drive member 94 slidably mounted on a stud 96 secured to the floor portion 50 adjacent the front edge 97 of the base member 28. The stud 96 is located within a slot 98 in the drive member 94.

Figure 6:
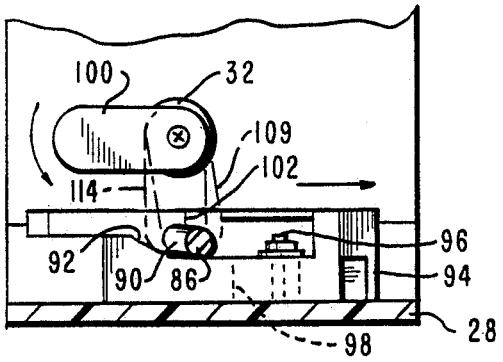
FIG. 6 is an enlarged sectional view of the release mechanism taken on line 6—6 of FIG. 3.

Referring to FIGS. 3 and 6, there is shown the keylock assembly 32 which includes a depending arm member 100. When the cash drawer 30 is in a latched position, the arm member 100 is aligned with a blocking surface 102 located on the drive member 94. As best seen in FIG. 2, the floor portion 50 has a forward extension portion 104 which includes an upstanding cam surface 106. When a key member 108 (FIG. 3) is inserted into the keylock assembly 32 and the assembly is rotated in a clockwise direction as viewed in FIG. 1, the arm 100 (FIG. 6) will be rotated from its solid-line portion to the position shown by broken line 109 to engage the blocking surface 102 of the drive member 94 moving the drive member to the left, as viewed in FIGS. 2 and 3, and to the right as viewed in FIG. 6. This movement of the drive member, as indicated by the arrow in FIG. 6, results in the cam surface 92 rocking the actuator rod member 86 in a counterclockwise direction as viewed in FIG. 6. This movement of the actuator rod member rotates its end portion 88 (FIG. 4) in the direction indicated by the arrow in FIG. 4 to rock the hooked end portion 62 of the blocking member 60 in a clockwise direction, as viewed in FIG. 3, which disengages the end portion 62 from the blocking surface 56 thereby releasing the cash drawer to the action of the spring member 76 in the manner described previously. In the present embodiment, the key member 108 is a supervisor's key which enables the latching mechanism 40 (FIGS. 2 and 3) to be disabled.

The movement of the drive member 94 to its actuated position, as shown in dotted line in FIG. 3, positions a cam surface 110 located at one end of the drive member 94 in line with a depending tab member 112 located on the lower surface of the cash drawer 30. Upon release of the cash drawer and its subsequent movement towards an open position under the action of the spring member 76, the tab member 112 will engage the cam surface 110 thereby moving the drive member 94 to its home position as shown in FIG. 3.

Figure 7:
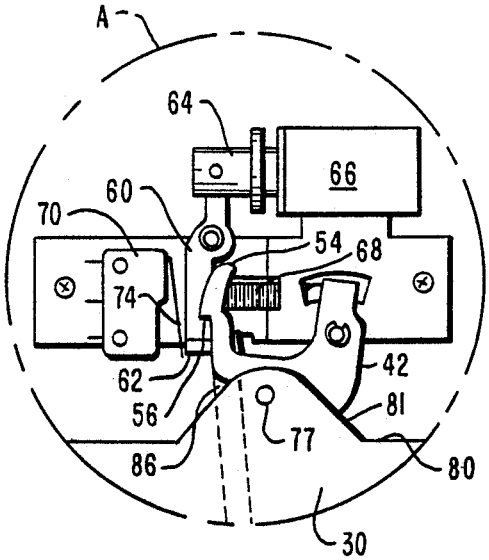
FIG. 7 is an enlarged partial top view of the latching mechanism located within the circle A in FIG. 3 showing the cash drawer in a locked position.
Figure 8:
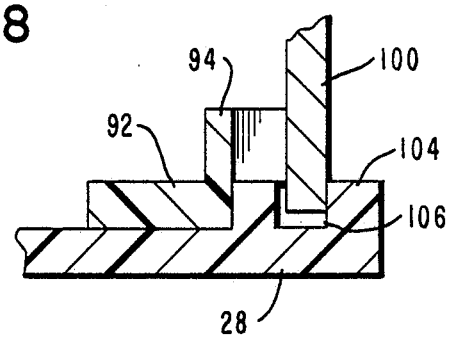
FIG. 8 is an enlarged partial sectional view of the cash drawer locking mechanism taken on lines 8—8 of FIG. 2.

In the present embodiment, the terminal operator will have a key similar to the supervisor's key, but will only be able to move the arm 100 to a vertical position as shown by broken line 114 in FIG. 6, for locking of the cash drawer 30, when said drawer is closed but not locked. This movement of the arm 100 will engage the cam surface 106 (FIG. 2) forcing the cash drawer to be moved towards the rear of the base member 28. As shown in FIG. 7, the rearward movement of the cash drawer 30 will enable the pin 77 to rotate the latch member 42 in a clockwise direction, as viewed in FIG. 3, removing the blocking surface 56 from engagement with the end portion 62 of the blocking member 60. In this locked position, the cash drawer will not be released from its latched position, if at this time, the solenoid 66 is operated since the cash drawer is held in closed position by the interaction between the arm 100 and the cam surface 106 (FIG. 8). When the solenoid 66 is deenergized, the end portion 62 (FIG. 7) of the blocking member 60 will return to a blocking position adjacent the blocking surface 56 of the latch member 42 thus latching the cash drawer when the arm 100 is removed from engagement with the cam surface 106.

The keylock assembly 32 is commercially available from the Engineered Security Products Corporation of Leo Minister, Mass., as part number 1022.

It will thus be seen that the manual release mechanism of the present invention enables a supervisor to release the cash drawer from engagement with the terminal in a relatively simple low-cost manner while allowing the operator to lock the cash drawer in the terminal when it is necessary to do so.

While the principles of the invention have now been made clear in an illustrated environment, it will be obvious to those skilled in the art that many modifications of structure, arrangement, elements and components can be made which are particularly adapted for specific environments and operating requirements without departing from these principles. The appended claims are therefore intended to cover and embrace any such modifications within the limits of the true spirit and scope of the invention.

What is claimed is:

1. A cash drawer assembly including a support member and a cash drawer slidably mounted on said support member for movement between an open and a closed position comprising:

a rotatably mounted latch member mounted to said support member for movement between a latched and unlatched position;

means engaging said latch member for normally urging the latch member to the unlatched position;

means mounted on said cash drawer for engaging and moving said latch member to a latched position latching the cash drawer in a closed position upon movement of the cash drawer to a closed position;

resilient means mounted on said support member and engaging said cash drawer when in a closed position for normally urging said cash drawer to a open position.

a rotatably mounted blocking member positioned adjacent said latch member, said blocking member including a latching portion adapted for movement to a position engaging said latch member upon movement of the cash drawer to a closed position, thereby holding the latch member in a latched position;

an elongated actuator member rotatably mounted on said support member and having one end positioned adjacent said blocking member and the other end positioned at the front edge of the support member;

a drive member slidably mounted on the front edge of said support member and having a first cam surface positioned adjacent the other end of said actuating member; and a key actuated locking member rotatably mounted in the front edge of the cash drawer, said locking member positioned adjacent the drive member when the cash drawer is in a closed position whereby the locking member, when rotated in a first direction by a key member, moves the drive member to an actuated position enabling the first cam surface to rotate the other end of said actuator member whereby the said one end of the actuator member is rotated to a position moving the blocking member from engagement with the latch member releasing the latch member from engagement with the cash drawer enabling the resilient member to move the cash drawer to an open position.

2. The cash drawer assembly of claim 1, in which the drive member includes a second cam surface and said cash drawer has a depending tab member extending from its lower surface, said tab member being aligned with the second cam surface of the drive member upon movement of the drive member to an actuated position whereby movement of the cash drawer to an open position enables the tab member to engage the second cam surface moving the drive member to its home position.

3. The cash drawer assembly of claim 2, in which said drive member has a slotted portion in which is mounted a fastening member for slidably mounting the drive member to the support member, said first cam surface comprising a sloped portion of said drive member located at one end of the drive member and said second cam surface being located at the opposite end of said drive member whereby movement of the cash drawer to an open position enables the tab member to engage the second cam surface to move the drive member to its home position.

4. The cash drawer assembly of claim 3, in which said support member includes a third cam surface mounted adjacent the front edge of the support member and the drive member, said locking member including an arm portion positioned adjacent the third cam surface upon movement of the cash drawer to a closed position whereby upon rotation of the key member in a drawer locking movement, said arm portion engages the third cam surface prior to engaging the drive member thereby moving the cash drawer in a direction towards said latch member resulting in the rotation of the latch member to a position disengaged from said blocking member which disables the blocking member from releasing the latch member upon movement of the blocking member from engagement with the latch member.

5. The cash drawer assembly of claim 4 in which said urging means is secured between said latch member and said blocking member for normally urging said blocking member into engagement with said latch member, said blocking member comprising a lever member rotatably mounted adjacent the latch member and having one end engaged by said urging means for normally urging said lever member into engagement with said latch member, and said drawer assembly further including a solenoid member engaging the other end of said lever member for moving, when operated, the lever member to a position releasing the latch member to the action of the urging means whereby the latch member is moved to an unlatched position.

6. The cash drawer assembly of claim 5, in which the latch member includes a blocking surface and said blocking portion comprises a depending tab portion of the lever member which is moved to a position engaging the blocking surface of the latch member upon movement of the cash drawer to a closed position, said one end of the elongated actuator member positioned adjacent the tab portion whereby upon rotation of the elongated actuator member by said drive member, said one end of the elongated actuator member will move the tab portion from engagement with the blocking surface thereby releasing the latch member to the action of the urging means.

7. In combination with an enclosure structure including a slidably mounted drawer member having an engaging member secured thereto, a latch apparatus for latching the drawer member in a closed position within said enclosure structure comprising:

a first latching member movably secured to said enclosure structure and positioned in the plane of movement of the drawer engaging member, said first latching member being moved to a latching position by the engaging member upon movement of the drawer member in a drawer member closing direction;

a second latching member rotatably mounted adjacent said first latching member;

a first spring member engaging said first and second latching members for normally urging said second latching member into engagement with said first latching member for latching the first latching member in a latching position upon movement of the first latching member to said latching position and for moving the first latching member to an unlatching position upon release of said first latching member by said second latching member;

a second spring member mounted on the enclosure structure and engaging said drawer member when in a closed position for normally urging said drawer member to an open position;

a solenoid member mounted on said enclosure structure and engaging said second latching member for rotating said second latching member to a position releasing said first latching member from said latching position when operated enabling said second spring member to move the drawer member to an open position;

a rod member rotatably mounted on said enclosure structure having one end positioned adjacent said second latching member and its opposite end positioned adjacent the front edge of the enclosure structure;

a drive member slidably mounted on said enclosure structure adjacent the opposite end of said rod member, said drive member having a actuating surface located at one end of the drive member which, when moved to an actuated position, engages and rotates the opposite end of said rod member enabling its said one end to disable said second latching member from engaging said first latch member whereby the first spring member rotates said first latching member from said latching position enabling the second spring member to move the drawer member to an open position; and a key operated rotatably mounted locking assembly having an arm member mounted on the drawer member and positioned adjacent the drive member when the drawer member is in a closed position whereby rotation of said locking assembly by a key member enables the arm member to engage and move the drive member to said actuated position thereby releasing the drawer member from the closed position.

8. The latch apparatus of claim 7, in which the drive member includes a first cam surface located at the other end of the drive member and said drawer member has a depending tab portion extending from its lowest surface, said tab portion being aligned with the first cam surface of the drive member upon movement of the drive member to an actuated position whereby movement of the cash drawer member to an open position enables the tab portion to engage the first cam surface on the drive member moving the drive member to its home position.

9. The latch apparatus of claim 8, in which said drive member comprises an elongated support member having a slotted portion in which is mounted a fastening member for slidably mounting the support member to the enclosure structure, said actuating surface comprising a sloped end portion of said support member whereby movement of the support member to an actuated position enables the sloped end portion of the support member to engage and rotate the opposite end of the rod member.

10. The latch apparatus of claim 9, in which said enclosure structure includes a second cam surface mounted adjacent the front edge of the enclosure structure and the drive member, said arm member being positioned adjacent the second cam surface upon movement of the drawer member to a closed position whereby upon rotation of the key member in a drawer locking movement, said arm member engages the second cam surface prior to engaging the drive member thereby moving the drawer member in a drawer closing direction resulting in the rotation of the first latch member to a position disengaged from said second latch member thereby disabling the solenoid member from releasing the first latching member by rotating the second latch member to a position releasing the first latch member from said latching position and holding the drawer member in a locked position.

11. The latch apparatus of claim 10 in which said second latching member comprises a lever member rotatably mounted adjacent the first latching member and having one end engaged by said solenoid member and its other end engaging said first latching member in a latching position whereby upon operation of the solenoid member, the lever member is rotated to a position releasing the first latching member to the action of the first spring member resulting in the first latching member being moved to an unlatching position.

12. The latch apparatus of claim 11 in which the first latching member includes a blocking surface and the other end of said lever member includes a depending tab portion engaging the blocking surface of the first latching member upon movement of the drawer member to a closed position, said one end of the rod member being positioned adjacent the tab portion whereby upon rotation of the rod member by said drive member, said one end of the rod member will move the tab portion from engagement with the blocking surface thereby releasing the first latching member to the action of the first spring member.

* * * * *